United States Patent [19]

Divo

[11] Patent Number: 4,681,695

[45] Date of Patent: Jul. 21, 1987

[54] BLEACH COMPOSITIONS

[75] Inventor: Michael Divo, Euskirchen, Fed. Rep. of Germany

[73] Assignee: The Procter & Gamble Company, Cincinnati, Ohio

[21] Appl. No.: 770,540

[22] Filed: Aug. 28, 1985

[30] Foreign Application Priority Data

Sep. 1, 1984 [GB] United Kingdom ..... 8422158

[51] Int. Cl.[4] ..... C11D 17/00

[52] U.S. Cl. ..... 252/94; 252/99; 252/100; 252/135; 252/142; 252/174.18; 252/186.2; 252/186.25; 252/545

[58] Field of Search ..... 252/91, 94, 95, 96, 252/97, 99, 174.18, 100, 174, 135, 142, 186.2, 186.25, 174.13, 545

[56] References Cited

U.S. PATENT DOCUMENTS

| | | | |
|---|---|---|---|
| 3,130,165 | 4/1964 | Brocklehurst | 252/99 |
| 3,163,606 | 12/1964 | Viveen et al. | 252/98 |
| 3,686,127 | 8/1972 | Boldingh | 252/99 |
| 3,833,506 | 9/1974 | Fries et al. | 252/99 |
| 3,925,234 | 12/1975 | Hachmann et al. | 252/97 |
| 4,003,841 | 1/1977 | Hachmann et al. | 252/94 |
| 4,009,113 | 2/1977 | Green et al. | 252/95 |
| 4,111,826 | 9/1978 | Leigh et al. | 252/89 R |
| 4,126,573 | 11/1978 | Johnson | 252/99 |
| 4,154,695 | 5/1979 | McCrudden et al. | 252/99 |
| 4,283,301 | 8/1981 | Diehl | 252/102 |
| 4,287,135 | 9/1981 | Stauber | 260/502 R |
| 4,288,388 | 11/1981 | McCrudden | 260/502 R |
| 4,290,903 | 9/1981 | MacGlip | 252/91 |
| 4,321,157 | 3/1982 | Harris et al. | 252/95 |
| 4,399,049 | 8/1983 | Grey et al. | 252/91 |
| 4,412,934 | 11/1983 | Chung | 252/186.38 |
| 4,444,674 | 4/1984 | Grey et al. | 252/95 |
| 4,483,781 | 11/1984 | Hartman | 252/95 |
| 4,486,327 | 12/1984 | Murphy et al. | 252/94 |
| 4,536,314 | 8/1985 | Hardy et al. | 252/102 |

FOREIGN PATENT DOCUMENTS

| | | |
|---|---|---|
| 1398785 | 6/1975 | United Kingdom . |
| 1540832 | 2/1979 | United Kingdom . |

*Primary Examiner*—Paul Lieberman
*Assistant Examiner*—Hoa Van Le
*Attorney, Agent, or Firm*—Robert B. Aylor; Richard C. Witte; Thomas H. O'Flaherty

[57] ABSTRACT

A bleach activator composition in the form of spray-dried granules having an inner core comprising water-soluble organic peroxyacid bleach precursor and a surface coating comprising a water-soluble or water-dispersible, inorganic hydratable material, and wherein the composition has a pH (1% aqueous solution) in the range from about 3 to about 8.

The compositions have excellent storage stability and water dispersibility together with simplified processing. Bleach and laundry compositions containing the bleach activator are also disclosed.

25 Claims, No Drawings

BLEACH COMPOSITIONS

TECHNICAL FIELD

The present invention relates to bleach activator compositions. More particularly, it relates to bleach activator compositions prepared by spray drying for use in or with a detergent and/or bleach composition. The bleach activator compositions have excellent storage stability, physical strength and water-dispersibility, as well as simplified processing and reduced segregation in a full detergent or bleach product. The invention also relates to a process of making the compositions and also to laundry compositions containing water-soluble bleach activators.

BACKGROUND

It is well known that peroxygen bleaching agents, e.g., perborates, percarbonates, perphosphates, persilicates etc., are highly useful for chemical bleaching of stains found on both colored and white fabrics. Such bleaching agents are most effective at high wash solution temperatures, i.e., above about 60° C. to 70° C. In recent years, attempts have been made to provide bleaching compositions that are effective at lower wash solution temperatures. In consequence, there has been much industrial research to develop substances generally referred to as bleach activators, that render peroxygen bleaches effective at bleach solution temperatures below 60° C. These low temperature bleaches are useful in a variety of products intended for use under machine or hand-wash conditions, e.g., additive pre-additive or soak-type laundry compositions as well as all-purpose detergent compositions.

A bleach activator can generally be described as an organic peroxy acid bleach precursor which in the bleaching solution reacts with an inorganic peroxygen bleaching agent with release of the organic peroxy acid. Many such bleach activators are known in the art, most of which contain perhydrolysable N-acyl or O-acyl residues. Examples of these include succinic, benzoic and phthalic anhydrides, tetracetylethylene diamine and tetracetylglycouril, all of which are water-insoluble materials to varying degrees.

Water-soluble bleach activators are also known in the act and are described in detail in, for example, U.S. Pat. No. 4,412,934 and European Patent Application No. 84301070.3. These activators have a number of advantages over water-insoluble materials including rapid dispersibility in wash or bleach solution and also the ability to exhibit surface bleaching. On the downside, however, water-solubility greatly exacerbates activator stability problems resulting from interaction with moisture and peroxygen bleaching agent during prolonged storage in the bleach or detergent composition.

It is also known in the art to incorporate bleach acctivators in a detergents slurry for spray-drying (see GB-A-1540832) whereby the resulting detergent composition comprises the bleach activator homogeneously distributed therein. In the case of water-soluble bleach activators, however, it is found that the conventional crutching and spray-drying process results in essentially complete degradation of the activator.

It has now been found, however, that water-soluble bleach activators can be successfully crutched and spray-dried by incorporating an inorganic hydratable material in the crutcher slurry mix and adjusting the pH of the slurry to within the range from about 3 to about 8 prior to spray-drying. Moreover, the subsequent granule is found to combine excellent stability characteristics when stored in a detergent or bleach composition, as well as improved dispersibility on addition to the wash or bleach solution.

SUMMARY OF INVENTION

According to the present invention, therefore, there is provided a bleach activator composition in the form of spray-dried granules having an inner core comprising water-soluble organic peroxyacid bleach precursor and a surface coating comprising a water-soluble or water-dispersible, inorganic hydratable material, and wherein the composition has a pH (1% aqueous solution) in the range from about 3 to about 8.

The invention also relates to a process of making a granular bleach activator composition comprising forming an aqueous slurry of a water-soluble organic peroxyacid bleach precursor and a water-soluble or water-dispersable inorganic hydratable material, adjusting the pH of the slurry (1% solids) to within the range from about 3 to about 8, preferably from about 3.5 to about 7 and subjecting the slurry to spray-drying.

In its composition aspect, the compositions of the invention generally take the form of granules having an inner core comprising water-soluble bleach precursor encapsulated or substantially enclosed within a coating of water-soluble or dispersible inorganic hydratable material. In preferred embodiments, the inner core exists as an essentially spherical droplet or aggregation of spherical droplets of the bleach precursor.

The outer coating on the other hand comprises a water-soluble or water-dispersible inorganic hydratable material which in preferred embodiments, consists majorly (at least about 50%, preferably at least about 75%) of one or more acid salts having a $pK_a$ in the range from about 1 to about 9, preferably from about 2 to about 7, more preferably from about 3 to about 6.5. Suitable inorganic hydratable materials include disodium dihydrogen pyrophosphate, tetrasodium monohydrogen tripolyphosphate, trisodium dihydrogen tripolyphosphate, sodium bicarbonate, acidified pentasodium tripolyphosphate, acidified borax and acidified aluminosilicates and mixtures thereof. Strong acid hydratable salts such as sodium sulphate, magnesium sulphate, etc. can also be incorporated in minor amounts. In the final spray-dried granule, the hydratable material is preferably hydrated to an extent of from about 10% to about 90%, preferably from about 30% to about 60% of its hydration capacity (based on the highest hydrate which is stable at room temperature). Preferably, the inorganic hydratable material has no hydrate transition point below about 40° C. or consists majorly of such material (greater than about 50%, preferably greater than about 75% of total inorganic hydratable material).

In the present invention, pH control is all-important both for successful spray drying of the aqueous slurry mix and for stability of the resulting granular composition. In particular, the provision of a pH-regulated outer coating based on partly-hydrated inorganic hydratable material appears to be especially beneficial in providing both physical and chemical stabilization of the water-soluble bleach activator in the final detergent or bleach product. In practice, the pH of the granular composition (1% aqueous solution) should lie within the range from about 3 to about 8, preferably from about 3.5 to about 7, more preferably from about 4 to about 6.5, while the aqueous slurry for spray-drying should also be adjusted to within the same pH range (1% solids solution). Adjustment of pH can be achieved in various ways, for example, by incorporating inorganic acid salts having the required pH characteristics, or by adding mineral acids or organic acids to the crutcher mix to lower the pH into the prescribed range. Suitable organic acids herein include $C_8$–$C_{24}$ fatty acids, polycarboxylic acids, aminopolycarboxylic acids, polyphosphonic acids, aminopolyphosphonic acids and mixtures thereof.

The spray-dried granular bleach activator compositions herein generally comprise from about 0.1% to about 50%, preferably from about 1% to about 45% bleach precursor, and from about 10% to about 99.9%, preferably from about 25% to about 90% alkaline inorganic hydratable material. In addition, they generally have a bulk density of from about 300 to about 900 grams/liter, preferably from about 450 to about 750 grams/liter, and a weight average particle size of from about 0.15 to about 3 mm, preferably from about 0.5 mm to about 1.4 mm.

The aqueous slurry for spray drying comprises generally from about 30% to about 60% water, from about 0.05% to about 35%, preferably from about 0.5% to about 30%, more preferably from about 2% to about 25% bleach precursor, and from about 10% to about 69.95%, preferably from about 14% to about 63% alkaline inorganic hydratable material. The slurry is then heated to a temperature of from about 60° C. to about 90° C. and spray-dried in a current of air having an inlet temperature of from about 250° C. to about 350° C., preferably from about 275° C. to about 330° C., and an outlet temperature of from about 95° C. to about 125° C., preferably from about 100° C. to about 115° C.

The bleach activators used in the compositions and process of the invention are water-soluble materials, being soluble generally to an extent of at least about 1%, preferably at least about 5% by weight at 25° C. and pH 7. By 'soluble' is meant that the bleach activator/water system is free of solids at the specified concentration. The preferred bleach activator herein is a peroxyacid bleach precursor having the general formula I

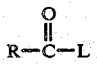

I wherein R is an optionally substituted alkyl group containing from 6 to 12 carbon atoms wherein the longest linear alkyl chain extending from and including the carbonyl carbon contains from 5 to 10 carbon atoms and L is a leaving group containing an anionic moiety, the conjugate acid of the leaving group having a $pK_a$ in the range from 6 to 13.

The group R can be either linear or branched and, in preferred embodiments, it is unsubstituted and contains from 7 to 9 carbon atoms. In another group of suitable bleach activators, the group R is substituted and has the general formula II

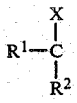

II wherein $R^1$ is straight or branched chain alkyl containing from 4 to 10, preferably 6 to 10, more preferably 6 to 8 carbon atoms, $R^2$ is H, $CH_3$, $C_2H_5$ or $C_3H_7$ and X is Cl, Br, $OCH_3$ or $OC_2H_5$.

L can be essentially any suitable leaving group containing a moiety which is anionic at pH 7. A leaving group is any group that is displaced from the bleach activator as a consequence of the nucleophilic attack on the bleach activator by the perhydroxide anion. Generally, for a group to be a suitable leaving group it must exert an electron attracting effect. Leaving groups that exhibit such behavior are those in which their conjugate acid has a $pK_a$ in the range of from 6 to 13, preferably from 7 to 11 and most preferably from about 8 to about 11. Also, in order for the activator to have the desired level of solubility in wash water it is essential that the leaving group contain an anionic moiety. Nonlimiting examples of suitable anionic moieties are —$SO_3M$, —COOM and —$OSO_3M$ wherein M is proton or a compatible cation.

Preferred bleach activators are those of the general formula I wherein L is selected from

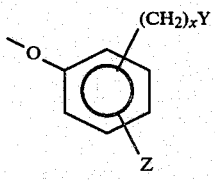

(a)

and

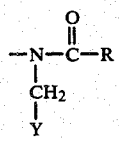

(b)

wherein Z is H, $R^3$ or halogen, $R^3$ is an alkyl group having from 1 to 4 carbon atoms, x is 0 or an integer of from 1 to 4 and Y is selected from $SO_3M$, $OSO_3M$ and $CO_2M$ and wherein M is H, alkali metal, alkaline earth metal, ammonium or substituted ammonium.

The preferred leaving group L has the formula (a) in which Z is H, x is O and Y is sulfonate or carboxylate. Highly preferred materials are sodium 3,5,5-trimethylhexanoyloxybenzene sulfonate, sodium 3,5,5,trimethexanoyloxybenzoate, sodium 2-ethylhexanoyl oxybenzenesulfonate, sodium nonanoyl oxybenzene sulfonate, sodium octanoyl oxybenzenesulfonate, sodium 2-chlorooctanoyloxybenzenesulfonate, sodium 2-chlorononanoyloxybenzenesulfonate, sodium 3,5,5-trimethyl-2-chlorohexanoyloxybenzene sulfonate, and sodium 2-chloro-2-ethyl-hexanoyloxybenzenesulfonate, the acyloxy group in each instance preferably being p-substituted.

The present invention also encompasses bleaching compositions, laundry detergent and laundry additive compositions comprising the bleach activator compositions detailed herein as well as laundry compositions incorporating the water-soluble bleach activator and detergent in a co-dried granule. Bleaching compositions according to the invention suitably contain from about 5% to about 99.5%, preferably from about 20% to about 90% of peroxygen bleaching agent and from about 0.5% to about 95%, preferably from about 10% to about 80% of bleach activator composition. Laundry compositions according to the invention generally contain from about 2% to about 40%, preferably from about 5% to about 25% of detersive surfactant selected from anionic, nonionic, cationic, ampholytic and zwitterionic surfactants and mixtures thereof and from about 0.1% to about 20%, preferably from about 0.5% to about 10% of the water-soluble organic peroxyacid bleach precursor. The surfactant and bleach precursor can either be co-spray dried or the surfactant can be incorporated in a separate laundry base composition. When co-spray dried, the spray dried granules contain the water-soluble or water-dispersible inorganic hydratable material at a level of from about 10% to about 90%, preferably from about 15% to about 70% by weight of the laundry composition and the spray-dried granules generally constitute from about 15% to 100%, preferably from about 25% to about 75% by weight of the laundry composition. When the surfactant is incorporated in a separate laundry base component, the bleach activator composition generally comprises from about 0.5% to about 40%, preferably from 1% to about 10% by weight of the laundry composition, and the base composition comprises from about 25% to about 99.5%, preferably from 35% to about 75% by weight of the laundry composition. In addition, the laundry compositions generally comprise one or more inorganic or organic detergency builders in a total level of from about 15% to about 90%, preferably from about 20% to about 60% by weight of the laundry composition, and peroxygen bleaching agent in a level of from about 5% to about 35%, preferably from about 8% to about 20% by weight of the laundry composition.

A wide range of surfactants can be used in the laundry compositions of the invention. U.S. Pat. Nos. 4,111,855 and 3,995,669 contain detailed listing of typical detersive surfactants.

Suitable synthetic anionic surfactants are water-soluble salts of $C_8$–$C_{22}$ alkyl benzene sulphonates, $C_8$–$C_{22}$ alkyl sulphates, $C_{10-18}$ alkyl polyethoxy ether sulphates, $C_{8-24}$ paraffin sulphonates, alpha-$C_{12-24}$ olefin sulphonates, alpha-sulphonated $C_6$–$C_{20}$ fatty acids and their esters $C_{10}$–$C_{18}$ alkyl glyceryl ether sulphonates, fatty acid monoglyceride sulphates and sulphonates, especially those prepared from coconut oil, $C_8$–$C_{12}$ alkyl phenol polyethoxy ether sulphates, 2-acyloxy $C_9$–$C_{23}$ alkane-1-sulphonate, and beta-alkyloxy $C_8$–$C_{20}$ alkane sulphonates.

A particularly suitable class of anionic surfactants includes water-soluble salts, particularly the alkali metal, ammonium and alkanolammonium salts or organic sulphuric reaction products having in their molecular structure an alkyl or alkaryl group containing from about 8 to about 22, especially from about 10 to about 20 carbon atoms and a sulphonic acid or sulphuric acid ester group. (Included in the term "alkyl" is the alkyl portion of acyl groups).

Examples of this group of synthetic detergents are the sodium and potassium alkyl sulphates, especially those obtained by sulphating the higher alcohols ($C_{8-18}$) carbon atoms produced by reducing the glycerides of tallow or coconut oil and sodium and potassium alkyl benzene sulphonates, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulphonates in which the average of the alkyl group is about 11.8 carbon atoms, abbreviated as $C_{11.8}$ LAS, and $C_{12}$–$C_{15}$ methyl branched alkyl sulphates.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred.

Suitable fatty acid soaps herein can be selected from the ordinary alkali metal (sodium, potassium), ammonium, and alkylolammonium salts of higher fatty acids containing from about 8 to about 24, preferably from about 10 to about 22 and especially from about 16 to about 22 carbon atoms in the alkyl chain. Fatty acids in partially neutralized form are also suitable for use herein, especially in liquid compositions. Sodium and potassium soaps can be made by direct saponification of the fats and oils or by the neutralization of the free fatty acids which are prepared in a separate manufacturing process. Particularly useful are the sodium and potassium salts of the mixtures of fatty acids derived from tallow and hydrogenated fish oil.

Mixtures of anionic surfactants are particularly suitable herein, especially mixtures of sulphonate and sulphate surfactants in a weight ratio of from about 5:1 to about 1:5, preferably from about 5:1 to about 1:1, more preferably from about 5:1 to about 1.5:1. Especially preferred is a mixture of an alkyl benzene sulphonate having from 9 to 15, especially 11 to 13 carbon atoms in the alkyl radical, the cation being an alkali metal, preferably sodium; and either an alkyl sulphate having from 10 to 20, preferably 12 to 18 carbon atoms in the alkyl radical or an ethoxy sulphate having from 10 to 20, preferably 10 to 16 carbon atoms in the alkyl radical and an average degree of ethoxylation of 1 to 6, having an alkali metal cation, preferably sodium.

The nonionic surfactants useful in the present invention are condensates of ethylene oxide with a hydrophobic moiety to provide a surfactant having an average hydrophilic-lipophilic balance (HLB) in the range from about 8 to 17, preferably from about 9.5 to 13.5, more preferably from about 10 to about 12.5.

Examples of suitable nonionic surfactants include the condensation products of primary or secondary aliphatic alcohols having from 8 to 24 carbon atoms, in either straight chain or branched chain configuration, with from 2 to about 40 moles, preferably 2 to about 9 moles of ethylene oxide per mole of alcohol. Preferably, the aliphatic alcohol comprises between 9 and 18 carbon atoms and is ethoxylated with between 2 and 9, desirably between 3 and 8 moles of ethylene oxide per mole of aliphatic alcohol. The preferred surfactants are prepared from primary alcohols which are either linear (such as those derived from natural fats or, prepared by the Ziegler process from ethylene, e.g. myristyl, cetyl, stearyl alcohols), or partly branched such as the Lutensols, Dobanols and Neodols which have about 25% 2-methyl branching (Lutensol being a Trade Name of BASF, Dobanol and Neodol being Trade Names of Shell), or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-2.5, Dobanol 91-3, Dobanol 91-4, Dobanol 91-6, Dobanol 91-8, Dobanol 23-6.5, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

Other suitable nonionic surfactants include the condensation products of $C_6$–$C_{12}$ alkyl phenols with from about 3 to 30, preferably 5 to 14 moles of ethylene oxide, and the compounds formed by condensing ethylene oxide with a hydrophobic base formed by the condensation of propylene oxide with propylene glycol, such synthetic nonionic detergents being available on the market under the Trade Name of "Pluronic" supplied by Wyandotte Chemicals Corporation.

Especially preferred nonionic surfactants for use herein are the $C_9$–$C_{15}$ primary alcohol ethoxylates containing 3–8 moles of ethylene oxide per mole of alcohol, particularly the $C_{12}$–$C_{15}$ primary alcohols containing 6–8 moles of ethylene oxide per mole of alcohol.

Cationic surfactants suitable for use herein include quaternary ammonium surfactants and surfactants of a semi-polar nature, for example amine oxides. Suitable quaternary ammonium surfactants are selected from mono $C_8$–$C_{16}$, preferably $C_{10}$–$C_{14}$ N-alkyl or alkenyl ammonium surfactants wherein remaining N positions are substituted by methyl, hydroxyethyl or hydroxypropyl and the corresponding di-$C_6$–$C_{10}$ N-alkyl or alkenyl ammonium surfactants. Suitable amine oxides are selected from mono $C_8$–$C_{20}$, preferably $C_{10}$–$C_{14}$ N-alkyl or alkenyl amine oxides and propylene-1,3-diamine dioxides wherein the remaining N positions are again substituted by methyl, hydroxyethyl or hydroxypropyl.

Suitable detergent builder salts useful herein can be of the polyvalent inorganic and polyvalent organic types, or mixtures thereof. Non-limiting examples of suitable water-soluble, inorganic alkaline detergent builder salts include the alkali metal carbonates, borates, phosphates, pyrophosphates, tripolyphosphates and bicarbonates.

Organic builder/chelating agents that can be incorporated include citric acid, nitrilotriacetic and ethylenediamine tetra acetic acids and their salts, organic phosphonate derivatives such as those disclosed in U.S. Pat. Nos. 3,213,030, 3,433,021, 3,292,121 and 2,599,807, and carboxylic acid builder salts such as those disclosed in U.S. Pat. No. 3,308,067. Preferred chelating agents include nitrilotriacetic acid (NTA), nitrilo(trimethylene phosphonic acid) (NTMP), ethylenediamine tetra(methylene phosphonic acid) (EDTMP) and diethylenetriamine penta(methylene phosphonic acid) (DETPMP). Mixtures of organic and/or inorganic builders can be used herein. One such mixture of builders is disclosed in CA-A-755,038, e.g. a ternary mixture of sodium tripolyphosphate, trisodium nitrilotriacetate, and trisodium ethane-1-hydroxy-1,1-diphosphonate.

A further class of builder salts is the insoluble alumino silicate type which functions by cation exchange to remove polyvalent mineral hardness and heavy metal ions from solution. A preferred builder of this type has the formulation $Na_z(AlO_2)_z(SiO_2)_y.xH_2O$ wherein z and y are integers of at least 6, the molar ratio of z to y is in the range from 1.0 to about 0.5 and x is an integer from about 15 to about 264. Compositions incorporating builder salts of this type form the subject of GB-A-1,429,143, DE-A-2,433,485, and DE-A-2,525,778.

An alkali metal, or alkaline earth metal, silicate can also be present in granular compositions of the invention. The alkali metal silicate is preferably from about 3% to about 15%. Suitable silicate solids have a molar ratio of $SiO_2$/alkali metal$_2$O in the range from about 1.0 to about 3.3, more preferably from 1.5 to 2.0.

The compositions herein can also contain bleaching components. In general, the bleach is selected from inorganic peroxy salts, hydrogen peroxide, hydrogen peroxide adducts, and organic peroxy acids and salts thereof. Suitable inorganic peroxygen bleaches include sodium perborate mono- and tetrahydrate, sodium percarbonate, sodium persilicate, urea-hydrogen peroxide addition products and the clathrate $4Na_2SO_4{:}2H_2O_2{:}1NaCl$. Suitable organic bleaches include peroxylauric acid, peroxyoctanoic acid, peroxynonanoic acid, peroxydecanoic acid, diperoxydodecanedioic acid, diperoxyazelaic acid, mono- and diperoxyphthalic acid and mono- and diperoxyisophthalic acid.

The compositions of the invention can be supplemented by all manner of detergent and laundering components, inclusive of suds suppressors, enzymes, fluorescers, photoactivators, soil suspending agents, anticaking agents, pigments, perfumes, fabric conditioning agents etc.

Suds suppressors are represented by materials of the silicone, wax, vegetable and hydrocarbon oil and phosphate ester varieties. Suitable silicone suds controlling agents include polydimethylsiloxanes having a molecular weight in the range from about 200 to about 200,000 and a kinematic viscosity in the range from about 20 to about 2,000,000 $mm^2/s$, preferably from about 3000 to about 30,000 $mm^2/s$, and mixtures of siloxanes and hydrophobic silanated (preferably trimethylsilanated) silica having a particle size in the range from about 10 millimicrons to about 20 millimicrons and a specific surface area above about 50 $m^2/g$. Suitable waxes include microcrystalline waxes having a melting point in the range from about 65° C. to about 100° C., a molecular weight in the range from about 4000–1000, and a penetration value of at least 6, measured at 77° C. by ASTM-D1321, and also paraffin waxes, synthetic waxes and natural waxes. Suitable phosphate esters include mono- and/or di-$C_{16}$–$C_{22}$ alkyl or alkenyl phosphate esters, and the corresponding mono- and/or di alkyl or alkenyl ether phosphates containing up to 6 ethoxy groups per molecule.

Enzymes suitable for use herein include those discussed in U.S. Pat. Nos. 3,519,570 and 3,533,139. Suitable fluorescers include Blankophor MBBH (Bayer AG) and Tinopal CBS and EMS (Ciba Geigy). Photoactivators are discussed in EP-A-57088, highly preferred materials being zinc phthalocyanine, tri- and tetra-sulfonates. Suitable fabric conditioning agents include smectite-type clays as disclosed in GB-A-1400898 and di-$C_{12}$–$C_{24}$ alkyl or alkenyl amines and ammonium salts.

Antiredeposition and soil suspension agents suitable herein include cellulose derivatives such as methylcellulose, carboxymethylcellulose and hydroxyethylcellulose, and homo- or co-polymeric polycarboxylic acids or their salts in which the polycarboxylic acid comprises at least two carboxyl radicals separated from each other by not more than two carbon atoms. Polymers of this type are disclosed in GB-A-1,596,756. Preferred polymers include copolymers or salts thereof of maleic anhydride with ethylene, methylvinyl ether, acrylic acid or methacrylic acid, the maleic anhydride constituting at least about 20 mole percent of the copolymer. These polymers are valuable for improving whiteness maintenance, fabric ash deposition, and cleaning performance of clay, proteinaceous and oxidizable soils in the presence of transition metal impurities.

Laundry additive products comprising bleaching or laundry detergent compositions in water-releasable combination with a non-particulate carrier as described in EP-A-96566 and EP-A-99197, are also suitable herein. A preferred carrier takes the form of a flexible sheet-like substrate, for example, an apertured non-woven fabric made of rayon with a nonionic self-cross-linking acrylic polymer as binder, the weight ratio of bleaching or bleaching detergent composition to substrate being at least about 1:1, preferably at least about 3:1, more preferably at least about 6:1. Carriers in the form of laminates, pouches and the like are also suitable, however.

In the Examples which follow, the abbreviations used have the following designations:

| | |
|---|---|
| LAS | Linear $C_{11.8}$ alkyl benzene sulphonate. |
| TAE(n) | Hardened tallow alcohol ethoxylated with n moles of ethylene oxide |
| AS | $C_{12-14}$ alcohol sulfate, sodium salt. |
| TAS | Tallow alcohol sulfate |
| CATAB | Coconut alkyl trimethyl ammonium bromide. |
| Dobanol 45-E-7 | A $C_{14-15}$ oxo-alcohol with 7 moles of ethylene oxide, marketed by Shell. |
| Silicate | Sodium silicate having an $SiO_2$:$Na_2O$ ratio of 1.6:1. |
| NTA | Sodium nitrilotriacetate |
| Gantrez AN-119 | Trade Name for maleic anhydride/vinyl methyl ether co-polymer, believed to have an average molecular weight of about 240,000, marketed by GAF. This was prehydrolysed with NaOH before addition. |
| MA/AA | Copolymer of 1:4 maleic acid/acrylic acid, average molecular weight about 80,000. |
| Brightener | Disodium 4,4'-bis(2-morpholino-4-anilino-s-triazino-6-ylamino)stilbene-2:2'-disulphonate. |
| Dequest 2060 | Trade Name for diethylenetriamine-penta(methylenephosphonic acid), marketed by Monsanto. |
| Dequest 2041 | Trade Name for ethylenediamine tetra(methylene phosphonic acid)monohydrate, marketed by Monsanto. |
| INOBS | Sodium 3,5,5-trimethyl hexanoyl oxybenzene sulphonate. |
| CNOBS | Sodium 4-(2-chlorononanoyloxo) benzene sulphonate. |
| Perborate | Sodium perborate tetrahydrate. |
| Clay | Sodium montmorillonite. |
| Zeolite A | 4 Å pore size. |
| Enzyme | Protease. |

The present invention is illustrated by the following non-limiting examples:

EXAMPLES I TO VI

Granular detergent compositions are prepared as follows. A detergent base powder composition is first prepared by mixing the indicated components in a crutcher as an aqueous slurry at a temperature of about 70° C. and containing about 35% water. The slurry is then spray dried at a gas inlet temperature of about 300° C. to form base powder granules. In Examples I to III, the detergent base powder contains water-soluble bleach activator in addition to the detersive components. In Examples IV to VI, a separate bleach activator composition is prepared by mixing the indicated components in a crutcher at a temperature of about 70° C. and containing about 38% water, the slurry being spray dried at a gas inlet temperature of about 300° C. and a gas outlet temperature of about 100° C. Finally, the detergent base powder composition is dry mixed with enzyme, silicate, carbonate, bleach and spray-dried bleach activator components, where present, and additional nonionic surfactant acid, where present, is sprayed onto the total mixture.

All percentages are given by weight of total detergent composition.

| | EXAMPLES | | | | | |
|---|---|---|---|---|---|---|
| | I | II | III | IV | V | VI |
| Detergent Base Powder | | | | | | |
| LAS | 6 | 5 | 8 | 5 | 8 | 5 |
| AS | 4 | — | 3 | — | — | 5 |
| TAS | — | 5 | — | 5 | 1 | 5 |
| CATAB | — | — | 2 | — | 1 | — |
| Gantrez AN119 | — | — | — | — | 1 | — |
| Silicate | — | — | — | 5 | 1 | 3 |
| MA/AA | 0.5 | 2 | 1 | 2 | — | 3 |
| Zeolite A | 18 | — | — | — | — | — |
| Brightener | 0.2 | 0.3 | 0.1 | 0.2 | 0.2 | 0.3 |
| NTA | 3 | — | — | — | — | — |
| Dequest 2060 | — | — | 0.3 | — | — | — |
| Dequest 2041 | 0.1 | 0.3 | — | 0.3 | 0.1 | — |
| EDTA | 0.2 | 0.3 | — | 0.2 | 0.2 | 0.2 |
| INOBS | 5 | 2.5 | — | — | — | — |
| Sodium tripolyphosphate | — | 24 | 28 | 25 | 30 | 22 |
| CNOBS | — | — | 2 | — | — | — |
| Magnesium sulphate (ppm) | 1000 | 1000 | 800 | 1000 | 1200 | — |
| Sodium sulphate, moisture & miscellaneous | | | to 100 | | | |
| pH (1% solution) | 6.8 | 7.5 | 6.5 | 10.1 | 9.8 | 9.9 |
| Bleach Activator Composition | | | | | | |
| INOBS | — | — | — | 4 | — | 2 |
| CNOBS | — | — | — | — | 4 | — |
| Sodium tripolyphosphate | — | — | — | 3 | 3 | 1 |
| Disodium dihydrogen pyrophosphate | — | — | — | 1 | 2 | 0.5 |
| Sodium sulphate | — | — | — | 0.5 | 1 | 0.5 |
| Dequest 2041 | — | — | — | — | — | 0.5 |
| Water | — | — | — | 1 | 1 | 0.5 |
| pH (1% solution) | — | — | — | 6.5 | 6.2 | 6.5 |
| OTHER ADDITIVES | | | | | | |
| Enzyme | 0.4 | 0.6 | 1.0 | 0.5 | 0.6 | |
| Sodium perborate tetrahydrate | 24 | 20 | 14 | 21 | 22 | |
| Dobanol 45-E-7 | 5 | 4 | — | 2 | 4 | |
| Silicate | 2 | 5 | 7 | — | — | |
| Sodium carbonate | 18 | 13 | — | 10 | — | |

The above products combine excellent bleach activator stability, water dispersibility, granulometry and detergency performance across the range of wash temperatures and soil types.

What is claimed is:

1. A bleach activator composition in the form of spray-dried granules having an inner core consisting essentially of from 0.1% to about 50% water-soluble organic peroxyacid bleach precursor and a surface coating comprising from about 10% to about 99.9% of water-soluble or water-dispersible, inorganic hydratable material, and wherein the composition has a pH as a 1% aqueous solution in the range of from about 3 to about 7.

2. A composition according to claim 1 wherein the inner core comprises an essentially spherical droplet of peroxyacid bleach precursor.

3. A composition according to claim 2 wherein the organic peroxy bleach precursor has the general formula I

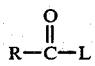

I wherein R is an alkyl or substituted alkyl group containing from 6 to 12 carbon atoms wherein the longest linear alkyl chain extending from and including the carbonyl carbon contains from 5 to 10 carbon atoms and L is a leaving group containing an anionic moiety, the conjugate acid of the leaving group having a $pK_a$ in the range from 6 to 13.

4. A composition according to claim 3 wherein the inorganic hydratable material consists majorly of one or more acid salts having a $pK_a$ in the range from about 2 to about 7.

5. A composition according to claim 4 having a pH in the range from about 3.5 to about 7.

6. A composition according to claim 4 wherein the inorganic hydratable material is selected from the group consisting of disodium dihydrogen pyrophosphate, tetrasodium monohydrogen tripolyphosphate, trisodium dihydrogen tripolyphosphate, sodium sulphate, magnesium sulphate, sodium bicarbonate, acidified pentasodium tripolyphosphate, acidified borax and acidified aluminosilicates and mixtures thereof.

7. A composition according to claim 6 additionally comprising an organic acid selected from the group consisting of $C_8$–$C_{24}$ fatty acids, polycarboxylic acids, aminopolycarboxylic acids, polyphosphonic acids, aminopolyphosphonic acids and mixtures thereof.

8. A composition according to claim 4 wherein the inorganic hydratable material consists majorly of one or more materials having no transition point below 40° C.

9. A composition according to claim 3 consisting essentially of from 25% to about 99.9% of inorganic hydratable material.

10. A composition according to claim 3 having a bulk density of from about 300 to about 900 grams/liter and a weight average particle size of from about 0.15 to about 3 mm.

11. A bleach activator composition in the form of spray-dried granules consisting essentially of from about 0.1% to 50% of water-soluble organic peroxyacid bleach precursor coated with from about 10% to about 99.9% of water-soluble or water-dispersible inorganic hydratable material consisting majorly of one or more acid salts having a $pK_a$ in the range from about 1 to about 9, and wherein the composition has a pH (1% aqueous solution) in the range from about 3 to about 7.

12. A composition according to claim 11 wherein the organic peroxy bleach precursor has the general formula I

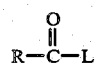

I wherein R is an alkyl or substituted alkyl group containing from 6 to 12 carbon atoms wherein the longest linear alkyl chain extending from and including the carbonyl carbon contains from 5 to 10 carbon atoms and L is a leaving group containing an anionic moiety, the conjugate acid of the leaving group having a $pK_a$ in the range of 6 to 13.

13. A composition according to claim 12 having a pH in the range from 3.5 to 7.

14. A composition according to claim 12 wherein the inorganic hydratable material is selected from the group consisting of disodium dihydrogen pyrophosphate, tetrasodium monohydrogen tripolyphosphate, trisodium dihydrogen tripolyphosphate, sodium sulphate, magnesium sulphate, sodium bicarbonate, acidified pentasodium tripolyphosphate, acidified borax and acidified aluminosilicates and mixtures thereof.

15. A process of making a coated granular bleach activator composition consisting essentially of forming an aqueous slurry containing, on a solids basis, from 0.1% to about 50% of water-soluble organic peroxyacid bleach precursor and from about 10% to about 99.9% of water-soluble or water-dispersible inorganic hydratable material, adjusting the pH of the slurry measured at a concentration of 1% solids to within the range from about 3 to about 7 and subjecting the slurry to spray-drying.

16. A composition according to claim 15 wherein the organic peroxy bleach precursor has the general formula I

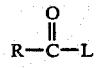

I wherein R is an alkyl or substituted alkyl group containing from 6 to 12 carbon atoms wherein the longest linear alkyl chain extending from and including the carbonyl carbon contains from 5 to 10 carbon atoms and L is a leaving group containing an anionic moiety, the conjugate acid of the leaving group having a $pK_a$ in the range from 6 to 13.

17. A process according to claim 16 wherein the slurry is adjusted to a pH of from about 3.5 to about 7.

18. A process according to claim 15 wherein the slurry comprises from about 30% to about 60% water, from about 0.05% to about 35% bleach precursor, and from about 10% to about 69.95% inorganic hydratable material.

19. A process according to claim 18 wherein the slurry has a temperature of from about 60° C. to about 90° C. and is spray dried at an air-inlet temperature of from about 250° C. to about 350° C. and an air-outlet temperature of from about 95° C. to about 115° C.

20. A bleaching composition comprising from about 5% to about 99.5% of peroxygen bleaching agent and from about 0.5% to about 95% of a bleach activator composition according to claim 1.

21. A laundry composition comprising from about 0.5% to about 40% by weight thereof of a bleach activator composition according to claim 1 together with 25% to 99.5% of a laundry base composition comprising from about 2% to about 40% by weight of laundry composition of surfactant selected from the group consisting of anionic, nonionic, cationic, ampholytic and zwitterionic surfactants and mixtures thereof.

22. A composition according to claim 21 wherein the organic peroxy bleach precursor has the general formula I

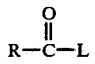

I wherein R is an alkyl or substituted alkyl group containing from 6 to 12 carbon atoms wherein the longest linear alkyl chain extending from and including the carbonyl carbon contains from 5 to 10 carbon atoms and L is a leaving group containing an anionic moiety, the conjugate acid of the leaving group having a $pK_a$ in the range from 6 to 13.

23. A composition according to claim 22 wherein the bleach activator granules have a pH in the range from about 3.5 to 7.

24. A composition according to claim 22 wherein the inorganic hydratable material is selected from the group consisting of disodium dihydrogen pyrophosphate, tetrasodium monohydrogen tripolyphosphate, trisodium dihydrogen tripolyphosphate, sodium sulphate, magnesium sulphate, sodium bicarbonate, acidified pentasodium tripolyphosphate, acidified borax and acidified aluminosilicates and mixtures thereof.

25. A composition according to claim 21 comprising from about 15% to about 90% of inorganic or organic detergency builder and from 5% to 35% of peroxygen bleaching agent.

* * * * *